US009979093B2

(12) United States Patent
Pu et al.

(10) Patent No.: US 9,979,093 B2
(45) Date of Patent: May 22, 2018

(54) ANTENNA APPARATUS, BASE STATION AND COMMUNICATIONS SYSTEM

(71) Applicant: Huawei Technologies Co., Ltd., Shenzhen, Guangdong (CN)

(72) Inventors: Tao Pu, Shanghai (CN); Pinghua He, Shenzhen (CN); Dewen Sun, Shenzhen (CN); Weihua Sun, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 343 days.

(21) Appl. No.: 14/304,494

(22) Filed: Jun. 13, 2014

(65) Prior Publication Data

US 2014/0313095 A1 Oct. 23, 2014

Related U.S. Application Data

(63) Continuation of application No. PCT/CN2012/086547, filed on Dec. 13, 2012.

(30) Foreign Application Priority Data

Dec. 13, 2011 (CN) ..... 2011 1 0415173

(51) Int. Cl.
*H01Q 19/185* (2006.01)
*H01Q 1/24* (2006.01)
(Continued)

(52) U.S. Cl.
CPC ..... *H01Q 19/185* (2013.01); *H01Q 1/246* (2013.01); *H01Q 1/42* (2013.01); *H01Q 21/0025* (2013.01);
(Continued)

(58) Field of Classification Search
CPC ... H01Q 19/185; H01Q 1/246; H01Q 21/0025
See application file for complete search history.

(56) References Cited

U.S. PATENT DOCUMENTS 7,889,147 B2 * 2/2011 Tam ..... H01Q 21/0025 343/700 MS
2008/0204350 A1 8/2008 Tam et al.
(Continued)

FOREIGN PATENT DOCUMENTS

CN 1710751 A 12/2005
CN 101192707 A 6/2008
(Continued)

OTHER PUBLICATIONS

Stange et al., "Components of a Highly Integrated DBF Terminal Antenna for Mobile Ka-Band Satellite Communications," 2003 IEEE MTT-S International Microwave Symposium Digest (vol. 1), pp. 583-586, Philadelphia, PA, USA, Institute of Electrical and Electronics Engineers, New York, New York (Jun. 8-13, 2003).

*Primary Examiner* — Jessica Han
*Assistant Examiner* — Amal Patel
(74) *Attorney, Agent, or Firm* — Leydig, Voit & Mayer, Ltd.

(57) ABSTRACT

Embodiments of the present invention provide an antenna apparatus, a base station and a communications system. The antenna apparatus includes: an antenna part, including a common radome; an active part, connected to the antenna part and including at least one active module, where each active module includes at least one antenna element, and an element reflector and a phase shifter and a radio frequency module that are corresponding to each antenna element, where the element reflector of the at least one active module is configured to implement an antenna function; and a common part, connected to the active part and the antenna part, and shared by the at least one active module in the active part, where the common part includes at least one common module. By using the above antenna apparatus, each radio frequency module can be flexibly configured, so as to simplify onsite replacement and maintenance operations.

19 Claims, 6 Drawing Sheets

(51) Int. Cl.
*H01Q 23/00* (2006.01)
*H01Q 1/42* (2006.01)
*H01Q 21/00* (2006.01)

(52) U.S. Cl.
CPC ..... *H01Q 21/0087* (2013.01); *H01Q 23/00* (2013.01)

(56) References Cited

U.S. PATENT DOCUMENTS

| | | | | |
|---|---|---|---|---|
| 2011/0032158 | A1* | 2/2011 | Rodger ..... | H01Q 1/02 343/702 |
| 2012/0206885 | A1 | 8/2012 | Pan et al. | |

FOREIGN PATENT DOCUMENTS

| | | | | |
|---|---|---|---|---|
| CN | 201503898 | U | 6/2010 | |
| CN | 201528038 | U | 7/2010 | |
| CN | 101950846 | A | 1/2011 | |
| CN | 102044736 | A | 5/2011 | |
| CN | 102097677 | A | 6/2011 | |
| CN | 102176536 | A | 9/2011 | |
| CN | 102509852 | A | 6/2012 | |
| CN | 102522634 | A | 6/2012 | |
| KR | 1020040071847 | A | 8/2004 | |
| KR | 1020050118348 | A | 12/2005 | |
| KR | 1020060016603 | A | 2/2006 | |
| WO | WO 2011130917 | A1 | 10/2011 | |
| WO | WO 2012044219 | A1 * | 4/2012 | ..... H01Q 1/1207 |

* cited by examiner

ANTENNA APPARATUS, BASE STATION AND COMMUNICATIONS SYSTEM

CROSS-REFERENCE TO RELATED APPLICATION

This application is a continuation of International Patent Application No. PCT/CN2012/086547, filed on Dec. 13, 2012, which claims priority to Chinese Patent Application No. 201110415173.6, filed on Dec. 13, 2011, both of which are hereby incorporated by reference in their entireties.

TECHNICAL FIELD

Embodiments of the present invention relate to the field of mobile communications, and in particular, to an antenna apparatus, a base station, and a communications system.

BACKGROUND

An early distributed radio base station system generally adopts an "RRU (Remote Radio Unit)+antenna" architecture, where the antenna is a passive unit. Generally, the "RRU+antenna" architecture is implemented in the following three forms:

1) The RRU is at the bottom of a tower, the antenna is on the tower, and the two are connected through a cable.

2) The RRU is on a tower and close to the antenna, and is mounted at the bottom or back of the antenna, and the two are connected through a cable.

3) A semi-integrated manner is adopted, where the RRU is mounted directly against the antenna and is blind-mated with the antenna or connected to the antenna through a cable.

In the semi-integrated manner of the RRU and the antenna, the RRU is generally mounted directly against the back of the antenna, where one antenna may bear one RRU or multiple RRUs. The RRU is connected to the antenna through a cable or is blind-mated with the antenna, where a waterproof design is required in both connection manners.

Later products evolve to integration of the RRU and the antenna. An antenna system integrating the RRU and a passive antenna is generally referred to as an AAS (Active Antenna System). The AAS integrates the RRU serving as an active unit and a base station antenna serving as the passive unit into one module to form a unity, thereby implementing integral installation and maintenance. Generally, a side where the RRU serving as the active unit is located is referred to as an active side, while a side where the antenna serving as the passive unit is located is referred to as an antenna side. During installation of the AAS adopting an integrated architecture, only the antenna needs to be mounted.

However, in the case of the foregoing integration manner of the RRU and the antenna, it is difficult to perform onsite replacement and maintenance and difficult to meet requirements for different product combinations.

SUMMARY

The present invention provides an antenna apparatus, which can simplify onsite replacement and maintenance operations and meet requirements for different product combinations.

According to one aspect, an antenna apparatus is provided, including: an antenna part, including a common radome; an active part, connected to the antenna part and including at least one active module, where each active module includes at least one antenna element, and an element reflector and a phase shifter and a radio frequency module that are corresponding to each antenna element, where the element reflector of the at least one active module is configured to implement an antenna function; and a common part, connected to the active part and the antenna part, and shared by the at least one active module in the active part, where the common part includes at least one common module.

According to another aspect, a base station is provided, including the above antenna apparatus.

According to still another aspect, a communications system is provided, including the above base station.

By using the above antenna apparatus, a problem in the prior art that it is difficult to perform integral replacement and maintenance in an integrated solution of the antenna apparatus can be solved, and flexible configurations can be performed, thereby meeting requirements for different product combinations.

BRIEF DESCRIPTION OF DRAWINGS

To describe the technical solutions in the embodiments of the present invention more clearly, the following briefly introduces the accompanying drawings required for describing the embodiments. Apparently, the accompanying drawings in the following description show merely some embodiments of the present invention, and a person of ordinary skill in the art may still derive other drawings from these accompanying drawings without creative efforts.

DESCRIPTION OF EMBODIMENTS

Figure 1:
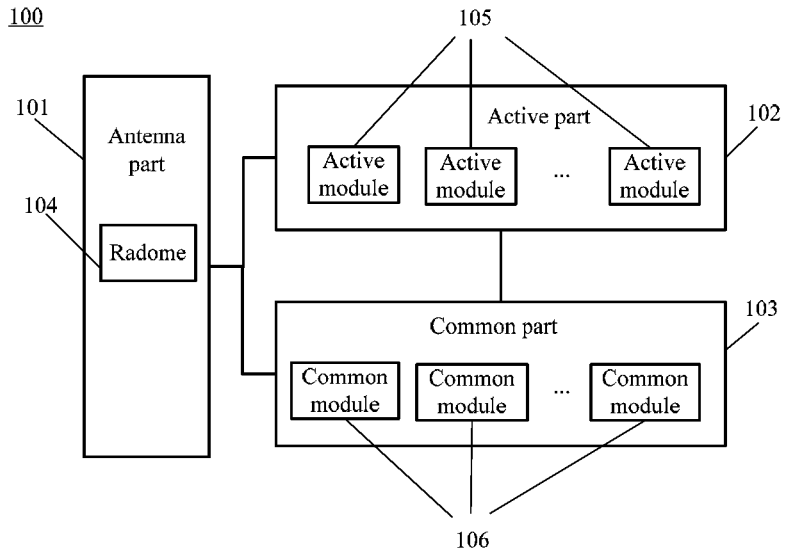
FIG. 1 is a schematic block diagram of an antenna apparatus according to an embodiment of the present invention.

The following clearly describes the technical solutions in the embodiments of the present invention with reference to the accompanying drawings in the embodiments of the present invention. Apparently, the described embodiments are a part rather than all of the embodiments of the present invention. All other embodiments obtained by a person of ordinary skill in the art based on the embodiments of the present invention without creative efforts shall fall within the protection scope of the present invention.

As mentioned above, for an AAS of a current distributed radio base station system, an RRU and an antenna are integrated, so that the RRU and the antenna form a unity, and are installed and maintained as a whole, and it is difficult to perform onsite replacement and maintenance due to the large external dimensions and weight thereof.

For example, in some scenarios, if the antenna is a low-frequency antenna like an 800 M-900 M antenna, its length may reach 2 m or even 2.6 m and its total weight may exceed 40 kg. This makes it difficult to perform integral installation and maintenance, and requires multiple persons (generally three to four persons) to perform operations on a tower and even requires a crane in some scenarios, thereby causing a high cost and difficult operations.

Moreover, such a manner in which the RRU and the antenna are integrated cannot be flexibly configured to meet requirements for product combinations. When there is a maintenance requirement due to an RRU fault or a capacity expansion requirement, the AAS must be removed as a whole and then re-installed as a whole after maintenance or replacement. The operations are relatively troublesome and the cost is high.

In addition, a Cube solution of the AAS is provided. In the Cube solution, the RRU is made into many independent small units and each independent small unit is a complete unit that includes an intermediate frequency board, a radio frequency board, a power amplifier, a duplexer, an element, a reflector, and a feeding network. By using an external common power supply and a common intermediate frequency board, these small units are combined into a product as required for application. In the above solution, a Cube refers to an independent unit, which includes complete content from the element to a part of intermediate frequency boards. The Cube can be flexibly configured and used in collaboration with a common module.

However, in some cases, it is possibly not required that an entire antenna apparatus should all be active antenna systems. For example, when the antenna apparatus includes multiple arrays of antennas, it may only be required that some arrays of antennas be active antennas and other arrays of antennas be passive antennas. However, the Cube solution cannot support integration of an active antenna and a passive antenna, thereby causing resource waste in the above cases. In addition, waterproofing and heat dissipation need to be independently implemented for each independent small unit Cube and also need to be implemented after integral combination. In addition, Cube onsite replacement also needs to be supported. Therefore, for the Cube solution of the AAS, it is complicated to implement details such as waterproofing, heat dissipation, and the like.

Therefore, in the embodiments according to the present invention, an antenna apparatus in a distributed radio base station system is expected to be provided. After integral installation of the antenna apparatus, when there is a maintenance requirement or a capacity expansion and frequency expansion requirement in the future, an active module, a passive module or a common module can be directly maintained on a tower, without removing the antenna.

In addition, to satisfy application of the integration of an active antenna and a passive antenna, in the antenna apparatus according to the embodiment of the present invention, an active module and a passive module can be mutually replaced to meet different product requirements, and furthermore, a partition granularity of active modules and passive modules is maintained according to an actual requirement.

FIG. 1 is a schematic block diagram of an antenna apparatus according to an embodiment of the present invention. As shown in FIG. 1, an antenna apparatus 100 includes an antenna part 101, an active part 102, and a common part 103. The antenna part 101 includes a common radome 104. The active part 102 is connected to the antenna part 101 and includes at least one active module 105. Each active module 105 includes at least one antenna element, and an element reflector and a radio frequency module that are corresponding to each antenna element, where the element reflector of at least one active module 105 is configured to implement an antenna function. The common part 103 may be a non-independently-disposed part or an independently-disposed part. When the common part 103 is a non-independently-disposed part, its implemented functions may be implemented by the active modules 105 separately, and the modules implementing the functions of the common part 103 may be distributed in the active modules 105, for example, in the radio frequency modules of the active modules 105. When the common part 103 is disposed independently, the common part 103 is connected to the active part 102 and the antenna part 101, and includes at least one common module 106. The common radome 104 is shared by the antenna elements included in the antenna apparatus 100.

Each active module 105 may further include a phase shifter corresponding to each antenna element.

In the above solution, the antenna part 101 does not have a reflector and may implement the function of a reflector of the entire antenna part by using a combination of element reflectors of the active part 102. Moreover, with regard to the common module, when the common part is disposed independently, some common parts in each active module 105 of the active part 102 are separated from each active module 105 to form an independent common module. For example, the independent common module may include a common power supply and a common intermediate frequency board.

In addition, the phase shifter included in the antenna part 101 can implement element sharing of active and passive antennas, which cannot be implemented in the above Cube solution. The element sharing of active and passive antennas are described in detail hereinafter.

By using the above antenna apparatus, a problem in the prior art that it is difficult to perform integral replacement and maintenance in an integrated solution of the antenna apparatus can be solved, and flexible configurations can be performed, thereby meeting requirements for different product combinations.

For convenience, in the schematic diagram in FIG. 1, the antenna element, the corresponding element reflector, phase shifter and radio frequency module included in each active module 105 are not shown. The following describes a schematic structure and an implementation manner of a single replaceable active module in detail.

Figure 2:
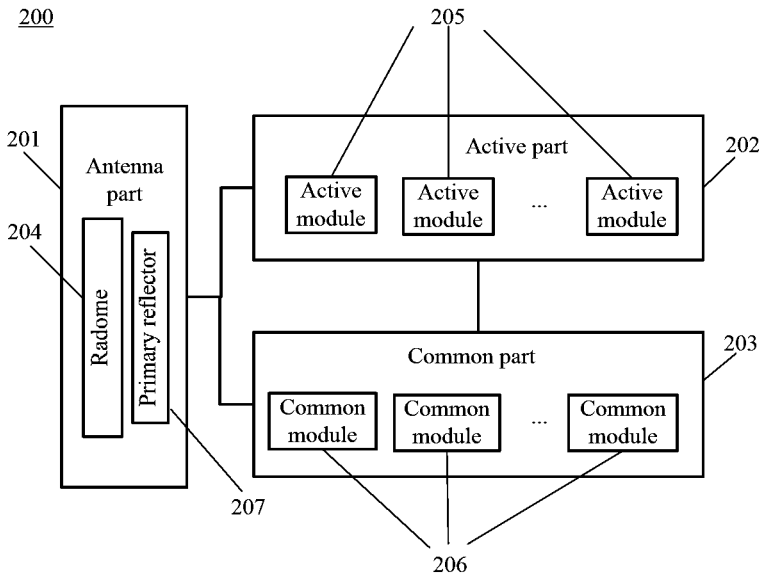
FIG. 2 is a schematic block diagram of another antenna apparatus according to an embodiment of the present invention.

In addition, in the embodiments of the present invention, the antenna part may further include a primary reflector that is configured to implement the antenna function in collaboration with the element reflector of an active module. FIG. 2 is a schematic block diagram of another antenna apparatus according to an embodiment of the present invention. As shown in FIG. 2, an antenna apparatus 200 includes an antenna part 201, an active part 202, and a common part 203. The antenna part 201 includes a common radome 204 and a primary reflector 207. The active part 202 is connected to the antenna part 201 and includes at least one active module 205. Each active module 205 includes at least one antenna element, and an element reflector, a phase shifter and a radio frequency module that are corresponding to each antenna element, where the element reflector of the active module 205 and the primary reflector 207 of the antenna part 201 implement an antenna function together. The common part 203 may be a non-independently-disposed part or an independently-disposed part. When the common part 203 is a non-independently-disposed part, its implemented functions may be implemented by the active modules 205 separately, and the modules implementing the functions of the common part 203 may be distributed in the active modules 205, for example, in the radio frequency modules of the active modules 205. When the common part 203 is disposed independently, the common part 203 is connected to the active part 202 and the antenna part 201, and includes at least one common module 206. The common radome 204 is shared by the antenna elements included in the antenna apparatus 200.

In the same way, for convenience, in the schematic diagram in FIG. 2, the antenna element, the corresponding element reflector, phase shifter and radio frequency module included in each active module 205 are not shown. In addition, a configuration of a single replaceable active module of the antenna apparatus shown in FIG. 2 is similar to that in FIG. 1, and both are described in detail hereinafter.

Figure 3:
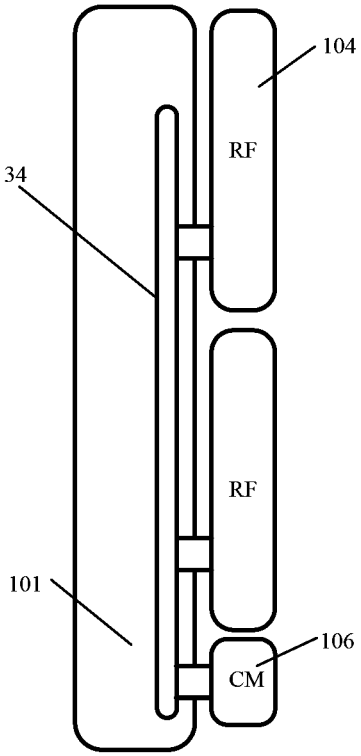
FIG. 3 is a schematic diagram showing a backplane connection of an antenna apparatus according to an embodiment of the present invention.

FIG. 3 is a schematic diagram showing a backplane connection of an antenna apparatus according to an embodiment of the present invention. In FIG. 3, an RF (Radio Frequency) indicates an active module 105 and a CM (Common Module) indicates a common module 106. The number of active modules 105 and the number of common modules 106 shown in FIG. 3 do not limit the scope of the embodiments of the present invention, but can be planned according to an actual requirement such as the number of antenna elements, network configuration, and a weight requirement for onsite replacement. The same parts in FIG. 3 and FIG. 1 are indicated by using the same reference signs.

As shown in FIG. 3, in the embodiments of the present invention, the active module 105 and the common module 106 are connected by using a backplane 34 on an antenna side, and furthermore, the active modules 105 are also connected to each other by using the backplane 34. A specific connection manner may be a blind-mated connection or a cable connection, and the embodiments of the present invention are not intended to make any limitation thereto.

In a conventional active antenna apparatus, an antenna part generally includes a radome, a primary reflector and multiple antenna elements that respectively correspond to multiple frequency bands. In the antenna apparatus in the embodiments of the present invention, the antenna element and a part of or all primary reflectors on the antenna side of the conventional active antenna apparatus are also incorporated into an active module actually, thereby forming a unity together with the active module. In this way, in addition to including all components, for example, a radio frequency board and a filter, of a radio frequency module of an active unit RRU in the conventional antenna apparatus, each active module according to the embodiment of the present invention further includes the antenna element and an element reflector in the antenna part of the conventional antenna apparatus. Moreover, multiple active modules 105 form an M*N combination according to an actual situation, where M and N are positive integers. The active module may further include a phase shifter. Furthermore, the active module may further include a combiner-divider and an interface connecting an active unit of a passive antenna, thereby enabling one antenna element to support both an active antenna and a passive antenna.

In the active module according to the embodiment of the present invention, the element reflector may be optimized, which is described hereinafter.

The following describes an implementation manner of a single replaceable active module in detail.

As mentioned above, in the antenna apparatus in the embodiments of the present invention, an active module and a passive module can be mutually replaced. Therefore, in the antenna apparatus shown in FIG. 1 to FIG. 3, at least one active module can be replaced with a passive module. For example, if an array of active modules is replaced with passive modules, this array of passive modules and an array of antennas corresponding to this array of passive modules form a passive antenna. Here, a person skilled in the art may understand that, if an architecture integrating an active antenna and a passive antenna is formed in the antenna apparatus according to the embodiment of the present invention, an array of passive antennas also need to be connected to an RRU in the conventional antenna apparatus to implement a function of an antenna. As mentioned above, in a case of replacing an active module with a passive module, the radio frequency module can be removed from the active module, that is, components of the active unit, such as the radio frequency board, the filter and the like, can be removed, while only the antenna element, the element reflector and the phase shifter are retained.

As mentioned above, in the antenna apparatus in the embodiments of the present invention, the antenna part may include a framework for one array of antennas or may include a framework for more than two arrays of antennas. The antenna part includes a common radome and may further include the primary reflector. In the embodiments of the present invention, after the element reflector embedded by the active module or the passive module and the primary reflector on a common antenna side are installed and combined, the function of the reflector included in the antenna part in the conventional antenna apparatus can be implemented, thereby implementing the function of an active antenna or a passive antenna. In the embodiments of the present invention, it is acceptable not to set any limitation on the installation and combination manner of the element reflector embedded by the active module or the passive module and the primary reflector of the antenna part. Moreover, a person skilled in the art may also understand that the antenna part may even include only the common radome. In this case, the element reflectors included in the active modules are configured to implement the antenna function and the element reflectors may be combined to form the reflector in the conventional antenna apparatus. That is to say, in this case, the antenna part may include no primary reflector and the function of the reflector is implemented by the element reflectors of the active modules.

Figure 4:
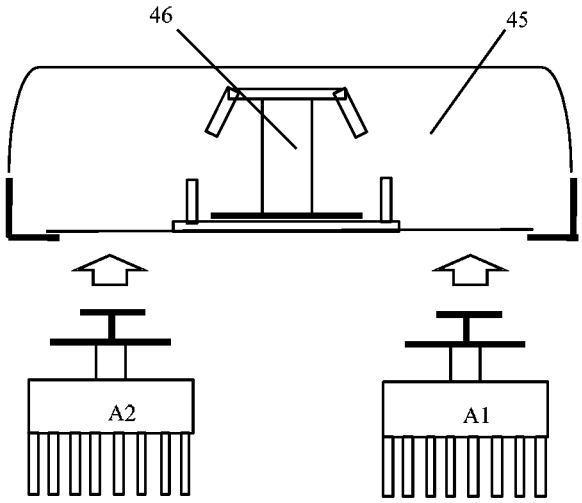
FIG. 4 is a schematic diagram showing a case where a part of elements are installed in advance in an antenna apparatus according to an embodiment of the present invention.

In the embodiments of the present invention, in some cases, elements corresponding to a part of frequency bands may also be installed directly on the primary reflector on the antenna side, thereby connecting to a radio frequency unit of the passive antenna to support the passive antenna. In addition, in a case where the primary reflector and phase shifter that are corresponding to the element have been fixed on the antenna side, it is inconvenient to perform onsite replacement. FIG. 4 is a schematic diagram showing a case where a part of elements are installed in advance in an antenna apparatus according to an embodiment of the present invention. As shown in FIG. 4, an antenna element 46 may be installed in advance in an antenna component 45. Moreover, active modules A1 and A2 may be installed on an antenna component and may be maintained or replaced on site separately during maintenance.

Here, if a part of passive elements, for example, 800-900 M low-frequency antenna elements, are not suitable for onsite replacement because they are large in size, the part of passive elements may be installed in advance and not be installed or replaced on site.

Figure 5:
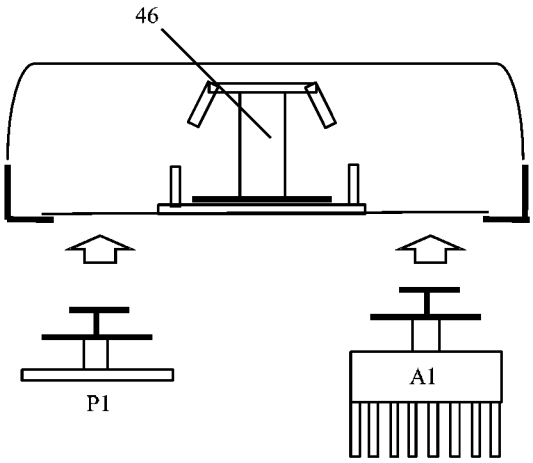
FIG. 5 is a schematic diagram showing a case where an active module and a passive module are installed in an antenna apparatus according to an embodiment of the present invention.

In addition, as mentioned above, in the embodiments of the present invention, an active module or a passive module may be installed on an antenna side. FIG. 5 is a schematic diagram showing a case where an active module and a passive module are installed in an antenna apparatus according to an embodiment of the present invention. As shown in FIG. 5, A1 indicates an active module and P1 indicates a passive module. Both A1 and P1 can be installed on an antenna side to form a system integrating an active antenna and a passive antenna. Moreover, when an active module is installed in the antenna apparatus according to the embodiment of the present invention, an antenna element in the active module can also support a passive antenna by using a combiner-divider and a phase shifter. For example, when the active module A1 is installed, A1 may be combined with the passive antenna to serve as an active antenna of a certain frequency band. In addition, the antenna element of the active module A1 may be connected to a radio frequency unit of the passive antenna by using the combiner-divider, the phase shifter, and an interface connected to an active unit of the passive antenna, which may serve as a passive antenna of another frequency band. The frequency band of the active antenna supported by the active module A1 is different from the frequency band of the supported passive antenna.

By performing mutual replacement of active modules and passive modules, a same array of antennas can support sharing of active and passive antennas except that the active and passive antennas have different frequency bands. Moreover, implementation of the element sharing of active and passive antennas is not supported by the above Cube solution.

Figure 6:
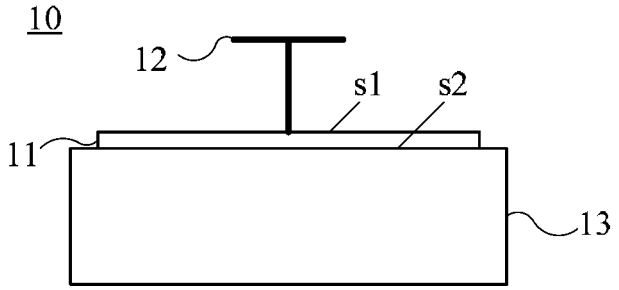
FIG. 6 is a schematic cross-section diagram of a single replaceable active module according to an embodiment of the present invention.

The following describes an implementation manner of a single replaceable active module in detail. FIG. 6 is a schematic cross-section diagram of a single replaceable active module according to an embodiment of the present invention. As shown in FIG. 6, an active module 10 includes an element reflector 11, an antenna element 12 and a radio frequency module 13. The element reflector 11 has a first surface s1 and a second surface s2 that is opposite to the first surface s1. The first surface s1 of the element reflector 11 is made of a conductive material. The antenna element 12 is disposed on the first surface s1 of the element reflector 11 and is electrically connected to the first surface s1. The radio frequency module 13 is disposed on the second surface s2 of the element reflector 11 and is electrically connected to the antenna element 12.

Optionally, as an embodiment, the element reflector 11 may be in a flat-plate shape shown in FIG. 6, but the embodiments of the present invention are not limited thereto. The element reflector 11 may include a side panel. The side panel is located on the first surface s1 of the element reflector 11. An inner side of the side panel is made of a conductive material. According to an actual requirement, the side panel may be implemented to enclose or semi-enclose the antenna element 12, for example, located on one side, two sides, three sides, or four sides of the antenna element 12.

Optionally, as another embodiment, the element reflector 11 may form a complete reflector independently or with a primary reflector of an antenna apparatus to form a convergent beam. For example, the element reflector 11 may be a printed circuit board (PCB, Printed Circuit Board). The first surface s1 of the element reflector 11 is laid with a conductive material such as copper. The element reflector 11 forms coupling with the primary reflector of the antenna apparatus, for example, forms capacitive coupling or conductive coupling. Here, mainly due to a passive intermodulation issue, close contact is required and no gap is allowed.

Optionally, as another embodiment, a feeding network is disposed on the second surface s2 of the element reflector 11. The feeding network may include at least one of a power splitter, a combiner, a coupler, a phase shifter, and the like. These components may be integrated to reduce cabling and an insertion loss.

Figure 7:
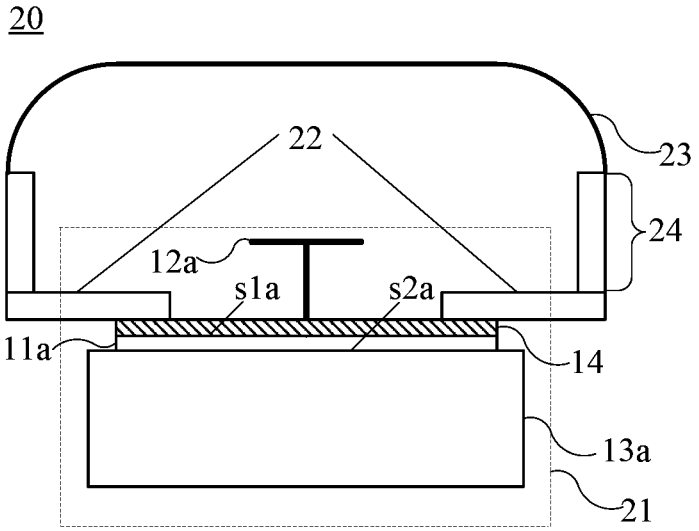
FIG. 7 is a schematic cross-section diagram of an antenna apparatus having a single replaceable active module installed according to an embodiment of the present invention.

FIG. 7 is a schematic cross-section diagram of an antenna apparatus having a single replaceable active module installed according to an embodiment of the present invention. The antenna apparatus 20 in FIG. 7 includes an active module 21, a primary reflector 22 and a radome 23.

FIG. 7 only shows an opening of the primary reflector 22 and an active module 21 that is installed through the opening, but the embodiments of the present invention are not limited thereto. It should be noted that the primary reflector 22 in FIG. 7 is an optional component. The primary reflector 22 may be cancelled in a case where an element reflector of the active module 21 can form a convergent beam independently. For the convenience of description, the following description assumes that the antenna apparatus is provided with a primary reflector.

The primary reflector 22 in the embodiment of the present invention may be provided with at least one opening. Through the at least one opening, at least one active module 21 may be installed in a removable manner. The radome 23 and the primary reflector 22 may be combined to form a unity, or may be installed together in a removable manner. For example, in a case where the at least one active module 21 is installed from one side of the primary reflector 22 facing the radome 23 (hereinafter referred to as a front side of the primary reflector 22) through the at least one opening in a removable manner, the radome 23 can be removed from the primary reflector 22 so as to facilitate installation of the active module 21. Or, in a case where the at least one active module 21 is installed from one side of the primary reflector 22 back to the radome 23 (hereinafter referred to as a rear side of the primary reflector 22) through the at least one opening in a removable manner, the radome 23 and the primary reflector 22 may be combined to form a unity, or may be installed together in a removable manner, without affecting installation of the active module 21.

As shown in a dashed box in FIG. 7, the active module 21 is an example of the active module 10 in FIG. 6. Therefore, similar parts are indicated by using similar reference numerals and a detailed description is appropriately omitted. In the embodiment shown in FIG. 7, the active module 21 includes an element reflector 11*a*, an antenna element 12*a* and a radio frequency module 13*a*. The element reflector 11*a* is in a flat-plate shape and, for example, may be a PCB. A first surface s1*a* of the element reflector 11*a* is laid with a conductive material (such as copper) as a ground.

In the embodiment shown in FIG. 7, length and width dimensions of the element reflector 11*a* of the active module 21 may be larger than or equal to length and width dimensions of the opening on the primary reflector 22. The active module 21 further includes an insulating film 14 that is disposed on the first surface s1*a* of the element reflector 11*a*. For example, the insulating film 14 may be green oil coated on the first surface s1*a*. A thickness of the insulating film 14 may be adjusted according to an actual requirement, and for example, may be greater than 0 and smaller than or equal to 2 mm, but the embodiments of the present invention are not limited to exemplary numeric values here.

By using the insulating film 14, as shown in FIG. 7, after the active module 21 is installed in the opening of the primary reflector 22, the primary reflector 22 and the element reflector 11*a* of the active module 21 form capacitive coupling, so that a radio frequency connection is formed between the primary reflector 22 and the antenna element 12*a* and a convergent beam is formed with the help of the primary reflector 22.

In the embodiment of FIG. 7, the element reflector 11*a* of the active module 21 is isolated from the primary reflector 22 with the insulating film 14, but the embodiments of the present invention are not limited thereto. In another embodiment, air may be used to replace the insulating film 14. That is, the element reflector 11*a* of the active module 21 is isolated from the primary reflector 22 with a gap. In this way, capacitive coupling may also be formed between the element reflector 11*a* and the primary reflector 22. A width of the gap may be set according to an actual requirement (for example, considering an assembly tolerance, an electrical index, and the like).

When the antenna apparatus includes multiple active modules, a component used for adjusting coupling or isolation between arrays and/or between elements may be disposed on the primary reflector 22, for example, a vertical slice part 24 on the primary reflector shown in FIG. 7.

Optionally, as another embodiment, a feeding network is disposed on the second surface s2*a* of the element reflector 11*a*. The feeding network may include at least one of a power splitter, a combiner, a coupler, a phase shifter, and the like. These components may be integrated to reduce cabling and an insertion loss.

Figure 8:
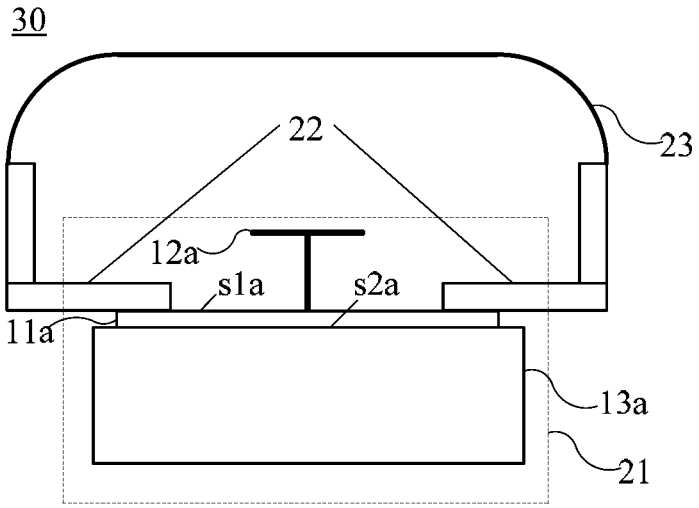
FIG. 8 is a schematic cross-section diagram of an antenna apparatus having a single replaceable active module installed according to another embodiment of the present invention.

FIG. 8 is a schematic cross-section diagram of an antenna apparatus having a single replaceable active module installed according to another embodiment of the present invention. An antenna apparatus 30 in FIG. 8 does not require an insulating film 14 either. Other parts are the same as those in FIG. 7 and therefore, the same reference numerals are used.

As shown in FIG. 8, after an active module 21 is installed in an opening of a primary reflector 22, the primary reflector 22 and an element reflector 11*a* of the active module 21 are fitted to form conductive coupling.

In the embodiment shown in FIG. 8, a first surface s1*a* of the element reflector 11*a* and the primary reflector 22 are both made of a conductive material and are in close contact, for example, through a bolt, a rivet, or adhesion; or the first surface s1*a* and an upper surface of the primary reflector 22 are smooth enough to make the first surface s1*a* and the primary reflector 22 fitted and form good conductive coupling. In this way, the primary reflector 22 and the element reflector 11*a* are configured to form a convergent beam together.

For other structures of the antenna apparatus 30, reference may be made to the description of FIG. 7, and no more description is given.

Figure 9:
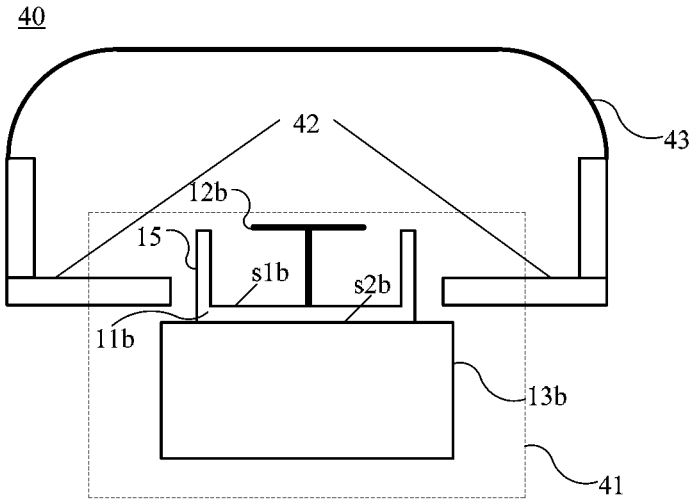
FIG. 9 is a schematic cross-section diagram of an antenna apparatus having a single replaceable active module installed according to still another embodiment of the present invention.

FIG. 9 is a schematic cross-section diagram of an antenna apparatus having a single replaceable active module installed according to still another embodiment of the present invention. The antenna apparatus 40 in FIG. 9 includes an active module 41, a primary reflector 42 and a radome 43.

For structures of the primary reflector 42 and the radome 43, reference may be made to the primary reflector 22 and the radome 23 in FIG. 7 and FIG. 8, and therefore no more description is given.

An element reflector 11*b* of the active module 41 includes a side panel 15. The side panel 15 is located on a first surface s1*b* of the element reflector 11*b* and encloses an antenna element 12*b*. An inner side of the side panel 15 is made of a conductive material. In an embodiment, a lower flat plate part of the element reflector 11*b* and the side panel 15 are integrally formed.

After the active module 41 is installed in an opening, an upper edge of the side panel 15 is higher than or aligned with a lower edge of the primary reflector 42. For example, the upper edge of the side panel 15 may be aligned with an upper surface of the antenna element 12*b* to protect an element during transportation, or may be higher or lower than the upper surface of the antenna element 12*b* according to a comprehensive consideration of electrical and structural design requirements.

In the embodiment shown FIG. 9, after the active module 41 is installed in the opening of the primary reflector 42, the primary reflector 42 and the element reflector 11*b* of the active module 41 form capacitive coupling. For example, as shown in FIG. 9, the element reflector 11*b* of the active module 41 is isolated from the primary reflector 42 with a gap. The gap between the primary reflector 42 and a side of the element reflector 11*b* may be designed according to an actual condition. For example, an assembly tolerance, an electrical index, and the like may be considered, but the embodiments of the present invention are not limited thereto.

The embodiment may also be similar to the embodiment in FIG. 8 so that the primary reflector 42 and the element reflector 11*b* of an active module 41 are fitted to form conductive coupling.

Length and width dimensions of the element reflector 11*b* in FIG. 9 are smaller than the length and width dimensions of the opening of the primary reflector 42. Therefore, the active module 41 may be installed from a rear side of the primary reflector 42. In this case, the radome 43 and the primary reflector 42 may be combined to form a unity, or may be installed together in a removable manner.

Optionally, as another embodiment, if dimensions of a radio frequency module 13*b* permit, for example, the length and width dimensions of the radio frequency module 13*b* are smaller than those of the opening, the active module 41 may also be installed from a front side of the primary reflector 42. In this case, the length and width dimensions of the element reflector 11*b* may be smaller than the length and width dimensions of the opening of the primary reflector 42, or may be greater than or equal to the length and width dimensions of the opening of the primary reflector 42. The radome 43 and the primary reflector 42 may be installed together in a removable manner.

If the length and width dimensions of the element reflector 11*b* are greater than or equal to the length and width dimensions of the opening of the primary reflector 42, the element reflector 11*b* may be isolated from the primary reflector 42 with the gap or an insulating film to form the capacitive coupling. Or, the element reflector 11*b* and the primary reflector 42 may also be fitted to form the conductive coupling.

Therefore, the element reflector 11*b* and the primary reflector 42 form a convergent beam together, which can adjust beam convergence.

In the same way, in an application where multiple arrays of antennas are combined, a component used for adjusting coupling or isolation between arrays and/or between elements may be disposed on the primary reflector 42.

A base station according to an embodiment of the present invention includes the above antenna apparatus.

A communications system according to an embodiment of the present invention includes the above base station.

The foregoing describes examples of a single replaceable active module and an antenna apparatus having the single replaceable active module installed according to the embodiments of the present invention. In the above antenna apparatus according to the embodiments of the present invention, an antenna element, an element reflector and a phase shifter are incorporated into an active module, and therefore a problem in the prior art that it is difficult to perform integral replacement and maintenance in the AAS integrated solution can be solved, and flexible configurations can be performed, thereby meeting requirements for different product combinations. Moreover, the active module and the passive module can be installed as required, thereby implementing application of the integration of an active antenna and a passive antenna.

The foregoing descriptions are merely specific embodiments of the present invention, but are not intended to limit the protection scope of the present invention. Any variation or replacement readily figured out by a person skilled in the art within the technical scope disclosed in the present invention shall fall within the protection scope of the present invention. Therefore, the protection scope of the present invention shall be subject to the protection scope of the claims.

What is claimed is:

1. An antenna apparatus comprising:

an antenna part comprising a radome shared by antenna elements, and a primary reflector comprising one or more openings;

an active part connected to the antenna part and comprising a plurality of modules, wherein at least one module is an active module;

each module is a single physical unit configured to be installed in the radome without affecting installation of other modules of the active part, and configured to be installed through the one or more openings in a removable manner; and each active module comprising at least one antenna radiator element, an element reflector, a phase shifter and a radio frequency module, wherein the element reflector is configured to implement a convergent beam;

wherein the antenna part further comprises one or more antenna radiator elements configured to serve as passive antennas at a frequency band corresponding to the antenna radiator element of at least one of the active modules, and configured to be installed on the primary reflector away from the one or more openings in a non-removable manner.

2. The antenna apparatus according to claim 1, wherein the antenna apparatus further comprises:

a common part, connected to the active part and the antenna part and shared by the at least one active module in the active part, wherein the common part comprises at least one common module.

3. The antenna apparatus according to claim 1, wherein the antenna apparatus further comprises:

a passive part, connected to the antenna part and comprising at least one passive module, wherein each passive module comprises at least one antenna element, an element reflector and a phase shifter corresponding to each antenna element, and the passive module is configured to form a passive antenna in combination with the antenna part.

4. The antenna apparatus according to claim 3, wherein:

the active module comprises an interface connected to a radio frequency unit of the passive antenna, wherein the interface is configured to connect the antenna element of the active module to the radio frequency unit of the passive antenna through a combiner-divider and the phase shifter of the active module; and the active module is configured to support the passive antenna at a frequency band that is different from a frequency band of an active antenna supported by the active module.

5. The antenna apparatus according to claim 3, wherein:

the antenna part comprises a framework for one or more than two arrays of antennas, wherein a part of the framework for the one or more than two arrays of antennas is connected to the active module to form an active antenna, and another part of the framework for the one or more than two arrays of antennas is connected to the passive module to form the passive antenna.

6. The antenna apparatus according to claim 1, wherein the element reflector of the active module and the primary reflector of the antenna part are configured to interact to provide the convergent beam.

7. The antenna apparatus according to claim 6, wherein the at least one active module is mechanically connected to the primary reflector through the one or more openings in a removable manner.

8. The antenna apparatus according to claim 7, wherein the primary reflector forms capacitive coupling with the element reflector of the at least one active module.

9. The antenna apparatus according to claim 6, wherein a component disposed on the primary reflector is used for one of the following:

(a) adjusting coupling or isolation between arrays of active modules and between the antenna elements of the active module, (b) adjusting coupling or isolation between the arrays, and (c) adjusting coupling or isolation between the antenna elements of the active module.

10. The antenna apparatus according to claim 6, wherein the radome and the primary reflector are mechanically combined to form an integral unit.

11. The antenna apparatus according to claim 6, wherein the radome and the primary reflector are coupled together in a removable manner.

12. The antenna apparatus according to claim 1, wherein:

the at least one active module is disposed as an M*N array, wherein each active module in the array supports same or different frequency bands, and M and N are positive integers.

13. The antenna apparatus according to claim 1, wherein:

the element reflector of the active module has a first surface and a second surface that is opposite to the first surface, and the first surface is made of a conductive material;

the antenna element is disposed on the first surface and is electrically connected to the first surface; and the radio frequency module is disposed on the second surface of, and is electrically connected to, the antenna element.

14. The antenna apparatus according to claim 13, wherein the element reflector of the active module further comprises a side panel that is located on the first surface and encloses the antenna element of the active module, and an inner side of the side panel is made of a conductive material.

15. The antenna apparatus according to claim 13, wherein the antenna apparatus further comprises an insulating film that is disposed on the first surface.

16. The antenna apparatus according to claim 13, wherein a feeding network is disposed on the second surface.

17. The antenna apparatus according to claim 1, wherein the element reflector of the active module is a printed circuit board (PCB).

18. A base station having an antenna apparatus comprising:

an antenna part comprising a radome shared by antenna elements, and a primary reflector comprising one or more openings; and an active part connected to the antenna part and comprising a plurality of modules, including at least one active module;

each module is a single physical unit configured to be installed in the radome without affecting installation and operation of other modules of the active part, and configured to be installed through the one or more openings in a removable manner; and each active module comprises at least one antenna radiator element, an element reflector, a phase shifter and a radio frequency module, wherein the element reflector is configured to implement a convergent beam;

wherein the antenna part further comprises one or more antenna radiator elements configured to serve as passive antennas at a frequency band corresponding to the antenna radiator element of at least one of the active modules, and configured to be installed in on the primary reflector away from the one or more openings in a non-removable manner.

19. A communications system comprising:

a base station including an antenna apparatus comprising antenna and active parts;

the antenna part comprising a radome shared by antenna elements, and a primary reflector comprising one or more openings;

the active part connected to the antenna part and comprising a plurality of modules, including at least one active module;

each module is a single physical unit configured to be installed in the radome without affecting installation and operation of other modules of the active part, and configured to be installed through the one or more openings in a removable manner; and each active module comprises at least one radiator antenna element, an element reflector, a phase shifter and a radio frequency module, wherein the element reflector of the at least one active module is configured to implement a convergent beam;

wherein the antenna part further comprises one or more antenna radiator elements configured to serve as passive antennas at a frequency band corresponding to the antenna radiator element of at least one of the active modules, and configured to be installed on the primary reflector away from the one or more openings in a non-removable manner.

* * * * *